United States Patent [19]

Geretzki

[11] Patent Number: 4,667,595

[45] Date of Patent: May 26, 1987

[54] INKING SYSTEM FOR MULTIPLE COLOR PRINTING BY A SINGLE PLATE CYLINDER

[75] Inventor: Helmut Geretzki, Lengerich, Fed. Rep. of Germany

[73] Assignee: Windmoller & Holscher, Lengerich, Fed. Rep. of Germany

[21] Appl. No.: 794,047

[22] Filed: Oct. 29, 1985

[30] Foreign Application Priority Data

Oct. 30, 1984 [DE] Fed. Rep. of Germany ..... 3439713
Feb. 18, 1985 [DE] Fed. Rep. of Germany ..... 3505598

[51] Int. Cl.[4] ..... B41F 31/04; B41F 31/08; B41F 31/06

[52] U.S. Cl. ..... 101/207; 101/366

[58] Field of Search ..... 101/207, 208, 209, 210, 101/148, 204, 206, 350, 363, 364, 366, 355, 356, 357, 351, 352

[56] References Cited

U.S. PATENT DOCUMENTS

| | | | |
|---|---|---|---|
| 3,198,113 | 8/1965 | Feller | 101/208 |
| 3,319,563 | 5/1967 | Champion et al. | 101/207 |
| 4,165,688 | 8/1979 | Leanna et al. | 101/207 |
| 4,559,871 | 12/1985 | Kutzner et al. | 101/366 |

FOREIGN PATENT DOCUMENTS

| | | | |
|---|---|---|---|
| 1062956 | 9/1979 | Canada | 101/366 |
| 1224327 | 9/1966 | Fed. Rep. of Germany . | |
| 3135711 | 2/1983 | Fed. Rep. of Germany . | |
| 3320638 | 1/1985 | Fed. Rep. of Germany . | |

*Primary Examiner*—J. Reed Fisher
*Attorney, Agent, or Firm*—Fleit, Jacobson, Cohn & Price

[57] ABSTRACT

An inking system for a rotary printing press, such as a flexographic printing press, including a pair of axially spaced doctor bars each having a pair of doctor blades to define ink chambers between the doctor bars and an inking roller. An ink separator plate is positioned between and in contact with the innermost ends of the doctor bars and includes a curved concave end face for intimate surface contact with the inking roller, to prevent intermixing of the separate ink colors that are provided to the respective ink chambers. The ink separator plate extends at right angles to the axis of the inking roller, and is pivoted on a pin that has an axis that is parallel to the axis of the inking roller to permit the plate to be urged by gravity into surface contact with the outer periphery of the inking roller.

7 Claims, 2 Drawing Figures

17
11b
16a
11
11a
2a
2
29'
23a
28
33
23
25
3
27
31
5
5a
9
7
11
III
11b
20
20
32
6
8
10
4
4a
III
11a
21
II
30
26
24
22
28'
22a
28
1
1a
II

INKING SYSTEM FOR MULTIPLE COLOR PRINTING BY A SINGLE PLATE CYLINDER

BACKGROUND OF THE INVENTION

1. Field of the Invention

This invention relates to printing apparatus, and more particularly to an ink recycling inking system for a rotary printing press wherein different ink colors are printed by a single plate cylinder.

2. Description of the Prior Art

In normal printing practice a single rotary plate cylinder is intended to print only a single ink color. For certain printing operations, e.g., in the printing of newspapers, it is often desired to apply ink in two or more different colors to a single plate cylinder at different positions along the axial length of the plate cylinder. For that purpose two or more doctor bars must be associated with the inking rollers and must be separated from each other so that ink of different colors can be applied to the inking roller in the desired portions and so that smearing or mixing of the different color inks will be avoided.

In German Patent Publication No. 1,224,327, there is disclosed an ink fountain which is intended for use in rotogravure printing machines and which includes separator walls to permit simultaneous printing with different color inks. The separator walls are spaced along the axis of the plate cylinder, and are in sliding contact with the periphery thereof. However, that structure does not include an ink fountain that is provided with two doctor blades, and the parts of the ink fountain that adjoin the separating wall and the highly elastic sealing bar provided on that wall are connected in a unit by means of screws, so that the separating wall cannot move relative to the adjoining doctor bars.

German Patent application Ser. No. 3,135,711 shows an ink recycling inking system that includes a doctor bar that has two doctor blades to define the walls of an ink chamber, but that is intended for applying ink of only a single color to an inking roller.

German Patent application Ser. No. 3,320,638 discloses an ink applying bar, which together with two doctor blades defines an ink trough and is divided by ink-separating plates into sections for different inks to be printed. The ink separating plates are guided in guide apertures in the ink applying bar, and are urged against a screen cylinder by means of leaf springs. However, if quick drying inks are employed, the movability of the ink separating plates can be adversely effected by ink that is drying in the guide apertures.

It is an object of the present invention to provide an ink recycling inking system that overcomes the shortcomings of the prior art identified above, and to provide an ink-recycling inking system that permits the application of printing inks of two or more different colors to a single plate cylinder at different positions along the axial length thereof without mixing of the inks.

SUMMARY OF THE INVENTION

Briefly stated, in accordance with one aspect of the present invention, an ink recycling inking system for a rotary printing press is provided. The printing press includes an inking roller and an adjacent plate cylinder that is in surface contact with the inking roller. The press includes supporting means that extends in the direction of the axis of the inking roller, for pivotally supporting against the inking roller at least two doctor bars, and an ink separator plate positioned between the two doctor bars. The ink separator plate extends at right angles to the axis of the inking roller and is pivotally supported on a pin that has an axis that is oriented to lie parallel to the axis of the inking roller. The pin is disposed above the center of gravity of the ink separator plate, and its axis is positioned between the axis of the inking roller and a vertical line that extends through the center of gravity of the ink separator plate. The ink separator plate has a concavely curved end face having the same radius of curvature as that of the inking roller, and is biased by gravity into sealing contact with the peripheral surface of the inking roller. The doctor bars each have opposed end faces that face the ink separator plate and are aligned with end faces of two doctor blades carried by each doctor bar, and engage with respective end faces of the ink separator plate. The doctor bars are mounted to be axially displaceable and are adapted to be urged into sealing contact with the adjacent side faces of the ink separator plate by suitable biasing means.

DESCRIPTION OF THE PREFERRED EMBODIMENTS

Figures 1, 3:
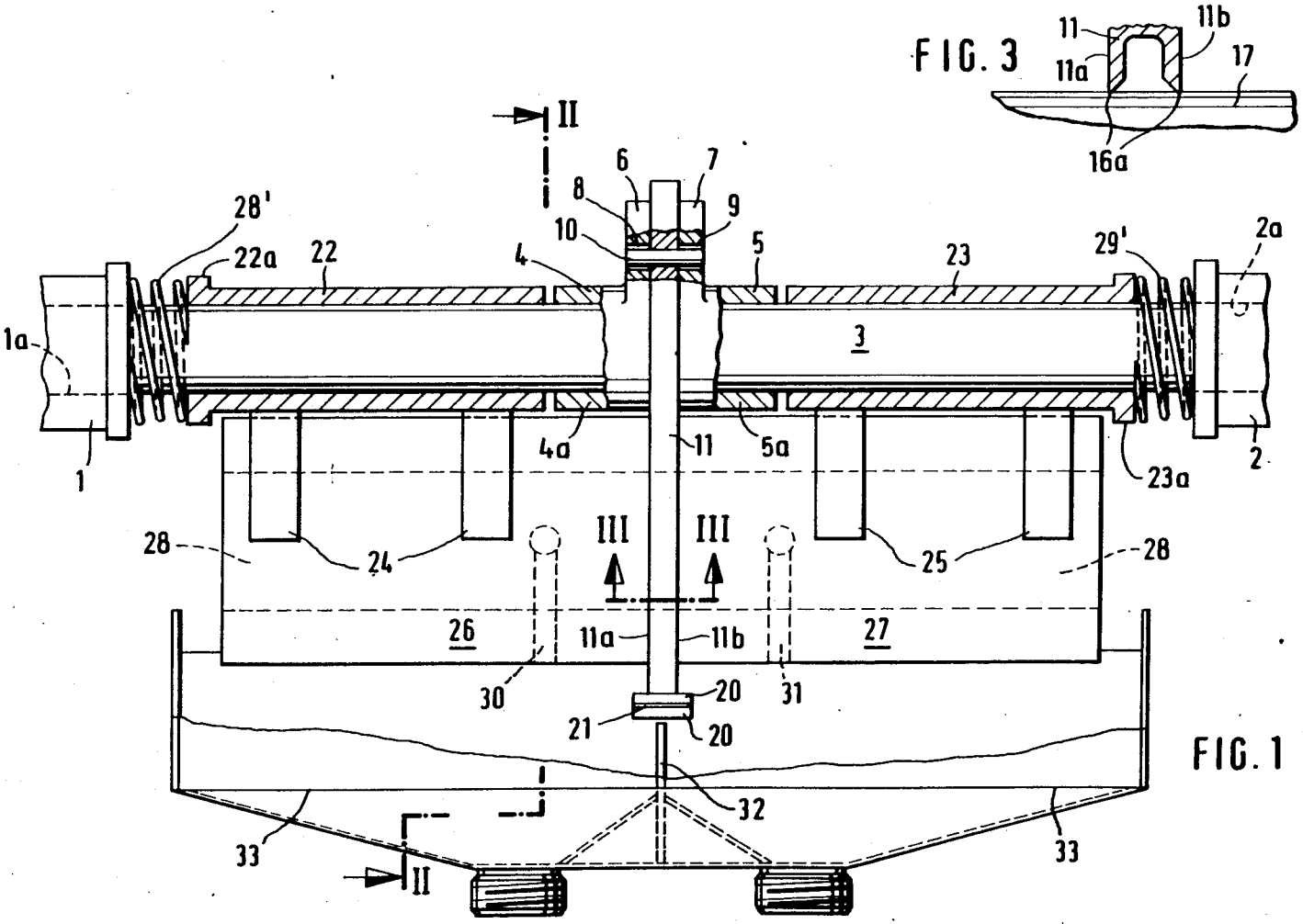
FIG. 1 is a front elevational view, partially in section, showing an inking system in accordance with the present invention and including an ink separator plate positioned to engage the peripheral surface of an inking roller.
FIG. 3 is an enlarged fragmentary view, partially in section, showing the area of contact between the separator plate and the inking roller, and taken along the line III—III of FIG. 1.
Figure 2:
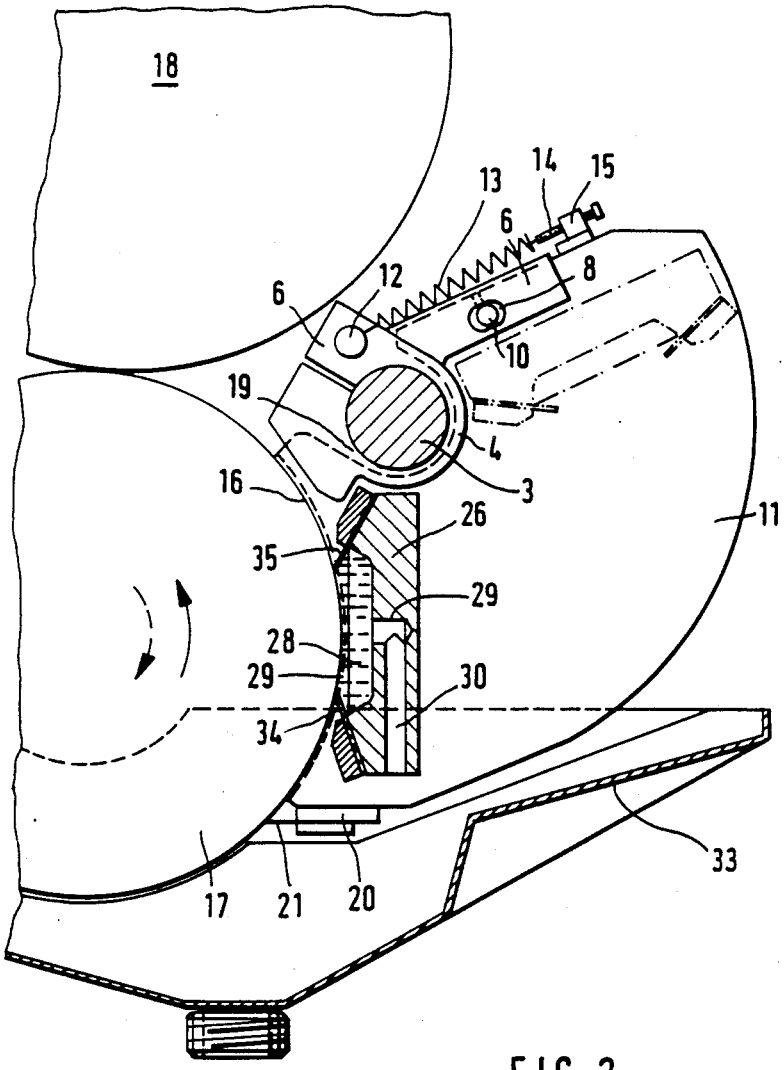
FIG. 2 is an end elevational view of the inking system, partially in section, and taken along the line II—II of FIG. 1.

Referring now to the drawings, and particularly to FIGS. 1 and 2 thereof, only a portion of a flexographic printing machine is shown, for purposes of clarity, and it is to be understood that the machine includes a frame (not shown). A pair of spaced support members 1, 2, extend in opposed relationship from the printing machine frame. Each of support members 1, 2, includes an aperture, 1*a* and 2*a*, respectively, within which is positioned a cylindrical support bar 3, the axis of which defines a pivot axis. A pair of brackets 4, 5, which include a tubular body 4*a*, 5*a*, respectively, are mounted on support bar 3 in spaced relationship therealong. Brackets 4, 5 include an elongated extension, 6, 7, respectively, which extensions include an elongated slot 8, 9, respectively. Slots 8, 9 are in alignment with each other and each has a longitudinal axis that extends along the length of the slot and passes through an inking roller 17 (see FIG. 2) that has an axis parallel to the axis of support bar 3. Each of the tubular bodies 4*a*, 5*a* of brackets 4, 5, includes a longitudinal gap defining a split portion for clamping the brackets to support bar 3 by means of a clamping bolt (not shown), in order to securely affix each of brackets 4, 5, to support bar 3 at predetermined positions therealong.

Slots 8 and 9 slidably receive a pin 10 that extends through each of the slots. Pin 10 is carried in an ink separator plate 11 that is pivotally suspended relative to the axis of pin 10. The pin is mounted in ink separator plate 11 in such a manner that the axis of pin 10 is offset from the center of gravity of the plate 11, and lies between the center of gravity of the plate and the axis of rotation of inking roller 17. Separator plate 11 includes end faces 11*a*, 11*b*, and is pivotal about the axis of pin 10. Brackets 4 and 5 are spaced from each other a distance sufficient to permit free pivotal movement of ink separator plate 11 therebetween and about the axis of pin 10.

Extensions 6 and 7 of brackets 4 and 5, respectively, are interconnected and held against relative rotation by pin 12 that extends through opposed apertures in each of extensions 6 and 7. The portion of pin 12 that extends within the space between brackets 4 and 5 carries one end of a tension spring 13, the other end of which is carried by the end of an adjusting screw 14 that is in screw threaded engagement with a support block 15 that is attached to the ink separator plate 11. Separator plate 11 includes a concavely curved end face 16 that is adapted to bear against the outer periphery of inking roller 17, the radius of curvature of end face 16 being the same as the radius of inking roller 17.

In order to permit pivotal movement of ink separator plate 11 about the axis of pin 10 so that end face 16 is in contact with inking roller 17, ink separator plate 11 includes a U-shaped opening 19 that surrounds a part of support bar 3 and is spaced therefrom when end face 16 is in engagement with the outer periphery of inking roller 17. Additionally, the lower portion of ink separating plate 11 includes a bracket 20 that carries a thin scraping bar 21, the forward end of which is adapted to be in contact with the outer periphery of inking roller 17. Scraping bar 21 has a width, in the axial direction of inking roller 17, that exceeds the thickness of ink separator plate 11.

Referring now to FIG. 3, the end face 16 of separator plate 11 is shown in enlarged, sectional form, with the plate in contact with the surface of inking roller 17. As therein shown, the end face 16 of ink separator plate 11 includes a groove formed in the end face 16 to define a pair of end edges 16*a* in the form of knife edges that are adapted to contact the outer periphery of inking roller 17.

Referring once again to FIG. 1, a pair of tubular support members 22, 23, are carried on support bar 3 for rotational and translational movement relative thereto. Each of tubular supports 22, 23 is mounted on opposite sides of and adjacent to brackets 4 and 5, respectively. Tubular supports 22, 23, include respective outermost end flanges 22*a*, 23*a*, and also include a plurality of respective holders, 24, 25 that extend outwardly from the axis of respective tubular members 22, 23. Holders 24, 25, carry respective ink duct doctor bars 26, 27, which are elongated structures that extend in the direction of the axis of inking roller 17 and that have a generally rectangular cross section, as shown in FIG. 2, with an ink chamber 28 formed in the side thereof that faces inking roller 17. Additionally, each of ink duct doctor bars 26, 27, includes an ink recycling bore 29, 30, which is in communication with the respective ink chamber, and also includes a pair of oppositely inclined doctor blades 34, 35, that form part of the top and bottom walls of the chamber 28, and the outermost edges of which are in contact with the outer periphery of inking roller 17. The doctor blades lie in respective intersecting planes that are parallel to the axis of rotation of inking roller 17. Ink is supplied to ink chamber 28 from an ink source (not shown) and fills ink chamber 28 to provide contact between the ink and inking roller 17. Excess ink flows from ink chamber 28 through ink recycling bores 30, 31 into an ink collecting trough 33. As best seen in FIG. 1, ink collecting trough 33 includes a partition member 32 to divide the trough into two portions, for each of two ink colors, partition 32 being positioned along the axis of inking roll 17 to underlie ink separator plate 11.

Referring once again to FIG. 1, each of tubular members 22, 23, and consequently ink duct doctor bars 26 and 27, is biased in a direction toward separator plate 11 by means of compression springs 28', 29', respectively, that are positioned between support members 1, 2, and end flanges 22*a*, and 23*a*, respectively, of tubular members 22 and 23. Further, the axial length of each of tubular members 22, 23, is such that when the innermost ends of ink duct doctor bars 26, 27, are in contact with ink separator plate 11, there is a gap between the innermost ends of tubular members 22, 23, and the outermost ends of each of brackets 4, 5, respectively, to permit the compression springs to maintain the ink duct doctor bars in close contact with the outermost surfaces of ink separator plate 11.

The innermost ends of each of ink duct doctor bars 26, 27, is in close contact with the outer surfaces 11*a*, 11*b*, respectively, of ink separator plate 11, the latter of which defines one end wall of ink chamber 28. The outermost ends of each of ink duct doctor bars 26, 27, are closed by splash guards (not shown), to provide a closure for the outermost ends of ink chambers 28.

The respective ink duct doctor bars are urged in a direction toward the axis of inking roller 17, by suitable biasing means in order to maintain close contact between respective doctor blades 34, 35, and the outer periphery of inking roller 17. An example of such a biasing means is a pneumatic cylinder and pivot arm arrangement as shown and described in U.S. Pat. No. 4,461,211, the disclosure of which is hereby incorporated herein by reference. However, the end face 16 of ink separator plate 11 is maintained in contact with the outer periphery of inking roller 17 by means of gravity alone.

In operation, inking roller 17 is positioned in contacting relationship with plate cylinder 18, and ink is supplied to respective ink duct doctor bars 26, 27 to fill the ink chambers 28 therein, each of the chambers containing ink of a different color. Ink separator plate 11 is in contact with the peripheral surface of inking roller 17 so that the knife edges formed on end face 16 are in contact therewith. Further, because pin 10 is pivotable within and slidable along slots 8 and 9, there is uniform pressure contact along the entire surface of end face 16, which is not normally obtained if the axis of rotation of ink separator plate 11 were to be maintained fixed in relation to the axis of rotation of inking roller 17, in which case there would be a differential contact pressure in that the lowermost portion of end face 16 would be urged more strongly against the peripheral surface of the inking roller than would be the upper portion of the end face. In the present embodiment, that differential contact pressure is offset by tension spring 13 and because pin 10 is slidable in slots 8 and 9. The initial tension of spring 13 can be so adjusted that the end face 16 contacts the inking roller at a uniform pressure throughout the arc length of the end face.

Scraping bar 21 that is mounted on the lower portion of ink separator plate 11 applies only a low contact pressure to the periphery of the inking roller 17, and it ensures that no residual ink will reach the peripheral edge portion of the ink separator plate. Further, the length of the scraping bar 21 in the direction of the axis of inking roller 17 is slightly greater than the width of the ink separating plate, and the bar is sufficiently flexible so that it will not adversely affect the desired snug contact between the concave end face of the ink separating plate and the periphery of the inking roller.

Although particular embodiments of the present invention have been illustrated and described, it will be apparent to those skilled in the art that various changes and modifications can be made without departing from the spirit of the present invention. It is intended to encompass in the appended claims all such changes and modifications that fall within the scope of the present invention.

What is claimed is:

1. An inking system for a rotary printing press including an inking roller and an adjacent plate cylinder in surface contact with the inking roller, said system comprising:

(a) supporting means carried by the printing press and extending in the direction of the axis of the inking roller for pivotally supporting at least two doctor bars and an ink separator plate;

(b) at least two elongated doctor bars having inner and outer ends and rotatably and longitudinally movably carried by said supporting means in spaced end-to-end relationship, each doctor bar carrying two doctor blades extending in respective intersecting planes that are each parallel to the axis of rotation of the inking roller, and are adapted for surface engagement with the outer periphery of the inking roller, each doctor bar having an ink chamber defined between the respective two doctor blades for receiving printing ink, each of the doctor bars having planar innermost end faces and having closed outermost ends to define a closed ink chamber between the doctor bars and the inking roller; and (c) an ink separator plate disposed between the innermost end faces of and between two doctor bars and extending at substantially right angles to the axis of the inking roller, said plate supported by said supporting means and carried on a pin received by said supporting means and having an axis substantially parallel to the axis of the inking roller, the pin disposed above the center of gravity of the ink separator plate and between the axis of the inking roller and a vertical line that extends through the center of gravity of the ink separator plate, said plate including a concavely curved end face having the same radius of curvature as that of the inking roller and in facing contact therewith, said end face being biased by gravity into sealing contact with the peripheral surface of the inking roller to provide a separation between respective ink chambers carried in each of the doctor bars.

2. An inking system according to claim 1, wherein said supporting means includes an elongated slot to slidably receive said pin for movement therealong, and for linear movement toward and away from the inking roller, and biasing means to bias the ink separator plate toward the inking roller, said biasing means engaging said plate at a point above its center of gravity.

3. An inking system according to claim 2, wherein said pin has an axis and said pin axis is positioned between a vertical plane passing through the axis of rotation of the inking roller and a vertical plane passing through the center of gravity of the ink separator plate.

4. An inking system according to claim 1, wherein the ink separator plate includes a groove formed on the end face thereof to define a pair of spaced side walls having spaced knife edges defining outermost end edges thereof.

5. An inking system according to claim 1, wherein said ink separator plate includes a scraping bar below its center of gravity and lying in a plane that is parallel to the axis of rotation of the inking roller, the scraping bar having a length along the axis of the inking roller which is greater than the width of the ink separator plate.

6. An inking system according to claim 1, including support members for pivotally carrying the doctor bars relative to the supporting means, and biasing means for urging the doctor bars against the ink separator plate, and the ink separator plate is pivotally supported by a pair of clamping members carried on said supporting means.

7. An inking system according to claim 6, wherein said biasing means includes compression spring.

* * * * *